United States Patent [19]

Kamo et al.

[11] Patent Number: 4,499,442

[45] Date of Patent: Feb. 12, 1985

[54] TRANSFER-TYPE ELECTROMAGNETIC RELAY COMPRISING A PERMANENT MAGNET UNDER A FIXED CONTACT STUD

[75] Inventors: Yuichi Kamo; Nobuo Mikami; Kazutoshi Wakamatsu; Kunio Naito, all of Tokyo, Japan

[73] Assignee: NEC Corporation, Tokyo, Japan

[21] Appl. No.: 511,508

[22] Filed: Jul. 6, 1983

[30] Foreign Application Priority Data

| | | | |
|---|---|---|---|
| Jul. 6, 1982 | [JP] | Japan | 57-117512 |
| Jul. 19, 1982 | [JP] | Japan | 57-109128[U] |
| Dec. 21, 1982 | [JP] | Japan | 57-224729 |
| Jan. 14, 1983 | [JP] | Japan | 58-4741 |

[51] Int. Cl.[3] ..... H01H 51/22

[52] U.S. Cl. ..... 335/79; 335/81

[58] Field of Search ..... 335/78, 79, 80, 81, 335/83, 84

[56] References Cited

U.S. PATENT DOCUMENTS

| | | | |
|---|---|---|---|
| 4,160,965 | 7/1979 | Kobler et al. | 335/79 |
| 4,215,329 | 7/1980 | Kobler | 335/79 X |
| 4,225,835 | 9/1980 | Vrsnak et al. | 335/81 X |
| 4,342,016 | 7/1982 | Yokoo et al. | 335/79 |

*Primary Examiner*—George Harris

*Attorney, Agent, or Firm*—Laff, Whitesel, Conte & Saret

[57] ABSTRACT

In a transfer-type electromagnetic relay comprising first and second lead members (26, 27) for first and second fixed contact studs (31, 32), respectively, and a third lead member (28) for an armature (36), first and second permanent magnets (46, 47) are directed to back surfaces of the first and the second lead members, respectively, with poles of the same name brought nearer to the respective leads. A single permanent magnet may be placed in the above-mentioned manner. Preferably, first and second arm members (43*a*, 43*b*) are attached to a leaf spring (37') fixed to the armature and extended from a central portion of the leaf spring on both sides thereof in directions different from each other. The leaf spring is manufactured without any bend and is therefore substantially flat. The third lead member partially comprises a non-magnetic portion at a center area thereof to support the armature. In order to provide make-before-break contacts, an armature height is rendered lower than a sum of a fixed contact height and a movable contact height given by each fixed contact stud and each movable contact stud.

12 Claims, 11 Drawing Figures

TRANSFER-TYPE ELECTROMAGNETIC RELAY COMPRISING A PERMANENT MAGNET UNDER A FIXED CONTACT STUD

BACKGROUND OF THE INVENTION

This invention relates to a transfer-type electromagnetic relay and to a method of manufacturing a relay support for use in supporting the transfer-type electromagnetic relay.

As disclosed in U.S. Pat. No. 4,342,016 issued to K. Yokoo et al. and assigned to the instant assignee, a conventional transfer-type electromagnetic relay of the type described comprises a housing and a contact assembly housed in the housing. The contact assembly comprises an armature swingable around an axis of swing placed on an armature lead to carry out contact transfer, a leaf spring carried on the armature, and a pair of movable contact studs attached to both ends of the leaf spring. A pair of fixed contact leads with fixed contact studs in the housing, are extended from the housing outwards. The fixed contact studs are selectively brought into contact with movable contact studs, respectively. Moreover, a permanent magnet is placed on the fixed contact lead to urge the armature towards a predetermined one of the fixed contact studs when the relay is deenergized. As a result, each permanent magnet must inevitably be placed axially outwardly of the fixed contact stud on the lead and be laterally spaced apart from the fixed contact stud. This means that a magnetic path becomes long between the permanent magnet and an end of the fixed contact lead which contacts with an armature. Thus, magnetization is weakened between the fixed and the movable contact studs. As a result, a large size or strong permanent magnet must be accomodated in the housing in order to compensate for the weakening of the magnetization. Accordingly, the conventional transfer-type relay is rendered bulky.

A pair of arm members are attached in the conventional transfer-type electromagnetic relay to the leaf spring along the leaf spring to reliably urge the armature towards the predetermined fixed contact stud when the relay is deenergized. For this purpose, each of the arm members is directed towards the same direction as the other. In this structure, stiffness of a pair of the arm members is varied in both cases where the armature is swung towards one of the fixed contact studs and where it is swung towards the other.

Each of the armature lead and the fixed contact leads is supported by a relay support serving as a part of the housing and is helpful to form a part of a magnetic path. Therefore, each lead is preferably made of a magnetic metal. In this event, magnetic interference is unavoidable between the armature lead and each fixed contact lead. In addition, it becomes difficult to manufacture the relay support with a high reliability and quality and further with a reduction in size of the relay.

Another conventional transfer-type electromagnetic relay comprises make-before-break contacts which are concurrently and momentarily closed on transferring the contacts from one to another. In this event, a card is indispensable so as to drive leaf springs to which a pair of movable contact studs are attached. Therefore, the conventional relay inevitably becomes complicated in structure.

SUMMARY OF THE INVENTION

It is an object of this invention to provide a transfer-type electromagnetic relay which is capable of avoiding a reduction of magnetization and is therefore compact.

It is another object of this invention to provide a transfer-type electromagnetic relay of the type described, which is invariable in sensitivity on swing movements towards both of fixed contact studs.

It is a further object of this invention to provide a transfer-type electromagnetic relay of the type described, which is simple in structure when the transfer-type electromagnetic relay is used to provide make-before-break contacts.

It is a yet further object of this invention to provide a transfer-type electromagnetic relay of the type described, which is capable of avoiding magnetic interference between an armature lead and each fixed contact lead even when the relay becomes compact in structure.

It is a still further object of this invention to provide a method of manufacturing a relay support for use in supporting the relay, which is capable of manufacturing the relay support in a high quality and reliability.

A transfer-type electromagnetic relay to which this invention is applicable comprises a housing and a contact assembly. The housing comprises a base member having an inner surface and a cap member defining a space in cooperation with the inner surface. The space has a space axis extended parallel to the inner surface. The inner surface is divisible into a center area extended transversely of the space axis and first and second end areas which are parallel to each other with the center area interposed therebetween. The contact assembly comprises a first, a second, and a third lead member which are extended from the first and the second end areas and the center area outwardly of the housing, respectively, and each of which has a front surface and a back surface, armature means swingably held on the front surface of the third lead member in the space, energizing means for electromagnetically energizing and deenergizing the armature means, and latching means for latching the armature means. The armature means is for carrying out seesaw movement in cooperation with the energizing and the latching means about an axis transverse to said space axis to electrically connect the first and the second lead members to the third lead member and to provide a first and a second contact on the front surfaces of the first and the second lead members, respectively. The energizing means is thereby for making the armature means carry out transfer of contact between the first and the second contacts. The latching means keeps at least a predetermined one of the first and the second contacts while the armature means is left deenergized. According to this invention, the latching means comprises at least one permanent magnet extending on at least a predetermined area preselected from the first and the second end areas transversely of the space axis. The permanent magnet has a selected one of north and south poles directed towards the back surface of one of the first and the second lead members that is extended from the predetermined area.

DESCRIPTION OF THE PREFERRED EMBODIMENTS

Figure 1:
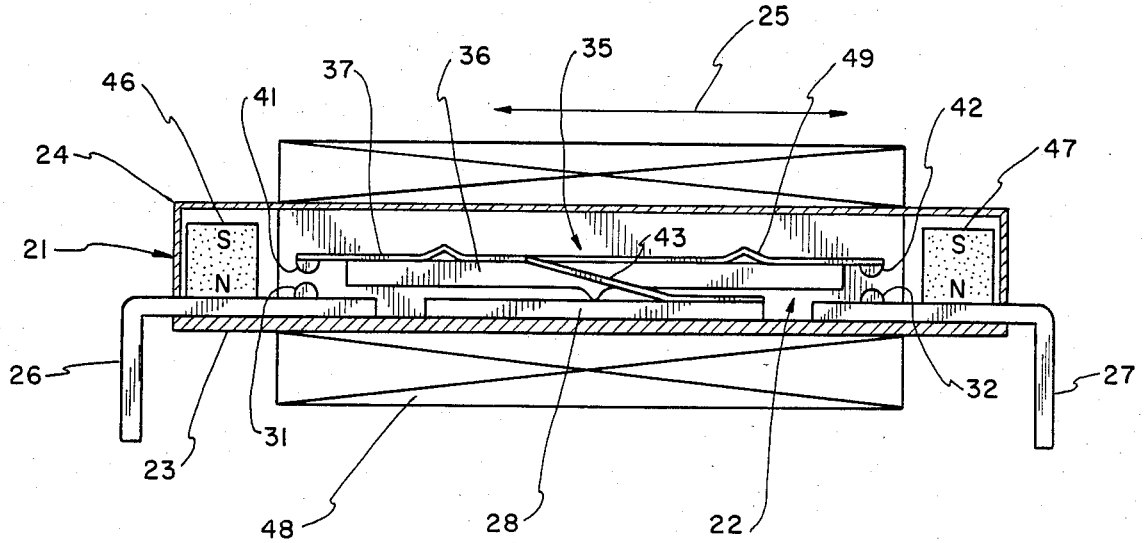
(PRIOR ART) FIG. 1
FIG. 1 schematically shows an axial sectional view of a conventional transfer-type electromagnetic relay.

Referring to FIG. 1, a conventional transfer-type electromagnetic relay will be described for a better understanding of this invention. The relay comprises a housing 21 of an insulator and a contact assembly 22. The housing 21 comprises a base member 23 having an inner surface and a cap member 24 defining a space in cooperation with the inner surface. The space has a space axis indicated by a line 25 and extended parallel to the inner surface. The inner surface is divisible into a center area extended transversely of the space axis and first and second end areas which are parallel to each other with the center area interposed therebetween. The first and the second end areas are extended transversely of the space axis 25.

The contact assembly 22 comprises first and second lead members 26 and 27 on the first and the second end areas, respectively, and a third lead member 28 on the center area. Each of the first, the second, and the third lead members 26, 27, and 28 is extended outwardly of the housing 21 and has a front and a back surface directed upwards and downwards of the figure, respectively. The first lead member 26 comprises a first support portion laid on the first end area and a first lead or elongated portion extending from the first support portion outwardly of the space. Likewise, the second and the third lead members 27 and 28 comprise second and third support portions and second and third lead or elongated portions, respectively. The second and the third support portions are laid on the second and the center areas, respectively.

First and second fixed contact studs 31 and 32 are attached to the first and the second support portions on the front surfaces thereof, respectively.

An armature member 35 is held on the front surface of the third support portion. The armature member 35 comprises an armature 36 extended along the space axis 25 and swingably brought into contact with the third support portion at a protrusion thereof. The protrusion is positioned along an axis transverse to the space axis 25. The armature 36 is rectangular in shape and is made of a soft magnetic material. A non-magnetic and electroconductive leaf spring 37 is welded or otherwise fixed onto the armature 36 at a central portion thereof. First and second extensions of the leaf spring 37 are extended from the central portion along the space axis 25 towards the first and the second end areas, respectively.

First and second movable contact studs 41 and 42 are attached to both ends of the first and the second extensions, respectively, and directed towards the first and the second lead members 26 and 27, respectively. A pair of arm members 43 are attached to both sides of the leaf spring 37 and extended along the space axis to be connected to the third lead member 28. It is mentioned here that both of the arm members 43 are extended in the same direction from the leaf spring 37 towards the second lead member 27, although a single arm member is illustrated in this figure.

First and second permanent magnets 46 and 47 are placed in the space on the front surfaces of the first and the second lead members 26 and 27, respectively. Each of the first and the second permanent magnets 46 and 47 is thus placed on each lead member axially outwardly of each fixed contact stud 31 and 32 and has a north pole near to and directed to each front surface of the lead members 26 and 27 and a south pole remote from each lead member 26 and 27.

A coil 48 is wound around the housing 21 and is operable to electromagnetically energize and deenergize the armature member 35 in cooperation with an electric power source (not shown).

The armature member 35 cooperates with the coil 48 and the first and the second permanent magnets 46 and 47 to carry out seesaw movement around the protrusion and to provide first and second contacts between the first movable contact stud 41 and the first fixed contact stud 31 and between the second movable contact stud 42 and the second fixed contact stud 32, respectively.

More particularly, the armature member 35 is deenergized while the coil 48 is not supplied with an electric current from the electric power source. In this event, it is assumed that the first movable contact stud 41 is connected to the first fixed contact stud 31 to provide the first contact in an initial state in which no electric current flows through the coil 48. Under the circumstances, when an electric current is caused to flow through the coil 48 in a predetermined sense to energize the armature member 35, the armature member 35 swings clockwise of the figure to carry out transfer of contact from the first contact to the second one. As a result, the second movable contact stud 42 is electrically connected to the second fixed contact stud 32 to provide the second contact. Once closed, the second contact is kept closed by a magnetic field produced by the second permanent magnet 47 even after the coil 48 is deenergized. In order to open the second contact, the electric current should be caused to flow through the coil 48 in the reversed sense.

At any rate, each of the first and the second permanent magnets 46 and 47 serves to keep a predetermined one of the first and the second contacts and therefore may be called a latching member.

In this structure, parallel placement of each permanent magnet 46, 47 and each fixed contact stud 31, 32 lengthens a magnetic path therebetween. Therefore, the conventional relay is disadvantageous in that each of the first and the second permanent magnets 46 and 47 must be strong or large as described in the preamble of the instant specification.

It is preferable that the stiffness of the armature member 35 (arms 43) be kept invariable when the armature member 35 is swung clockwise and counterclockwise. The armature member 35 should preferably be kept substantially parallel to the inner surface, as shown in FIG. 1, when the first and the second permanent magnets 46 and 47 are not used. Otherwise, the sensitivity of the relay is inevitably varied on both clockwise and counterclockwise swing movements. With the illustrated transfer-type electromagnetic relay, it is difficult to accomplish a constant stiffness because both of the arm members 43 are directed towards either one of the first and the second lead members 26 and 27. In addition, the leaf spring 37 should be manufactured with parts, such as 49, deformed in a direction of a thickness thereof. This is for reliably providing the first and the second contacts. The stiffness is seriously varied on both of clockwise and counterclockwise swing movements because the leaf spring 37 is not always uniformly deformed.

Figure 2:
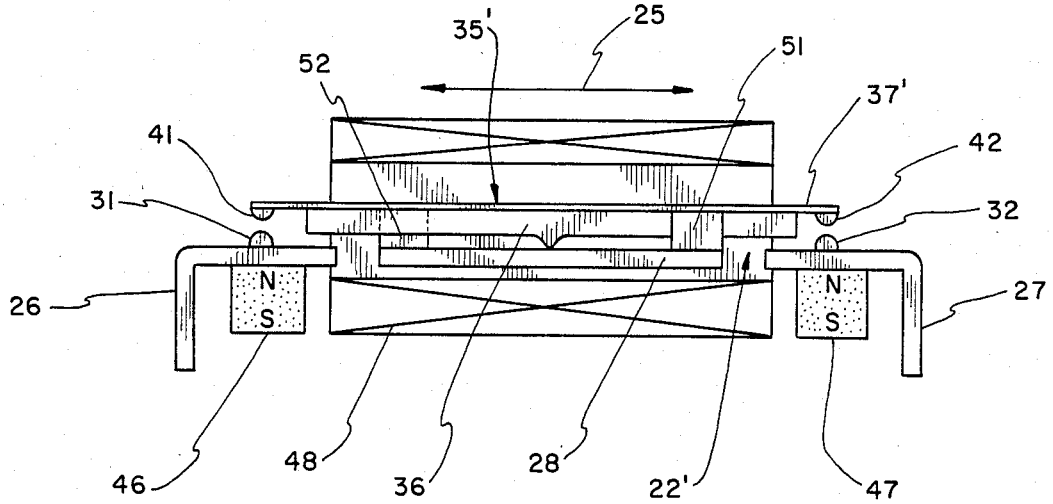
FIG. 2 schematically shows an axial sectional view of a transfer-type electromagnetic relay according to a preferred embodiment of this invention.
Figure 3:
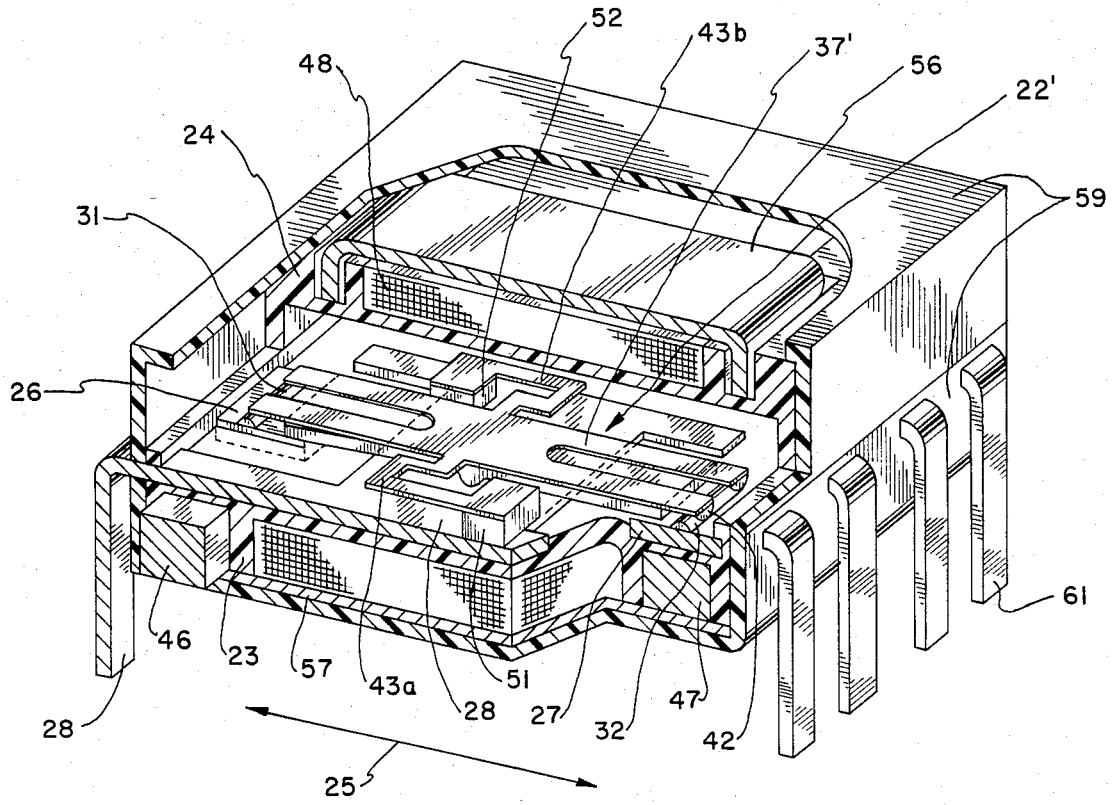
FIG. 3 shows a schematic perspective view of the transfer-type electromagnetic relay illustrated in FIG. 2, with parts cut away.

Referring to FIGS. 2 and 3, a transfer-type electromagnetic relay according to a preferred embodiment of this invention comprises similar parts designated by like reference numerals. As shown in FIG. 3, the illustrated relay may comprise a plurality of contact assemblies 22'.

Each contact assembly 22' comprises the first, the second, and the third lead members 26, 27, and 28 each of which has the front and the back surfaces, like the contact assembly 22 illustrated in conjunction with FIG. 1. The first through the third support portions are defined on the front surfaces of the first through the third lead members 26 to 28 to support the first and the second fixed contact studs 31 and 32 and an armature member 35' to be described later, respectively. The first through the third lead members 26 to 28 comprise the first through the third lead portions, respectively, like in FIG. 1. The third lead member 28 has a generally H-shaped configuration as shown in FIG. 3 and will later be described in detail. Each of the first through the third lead members 26 to 28 is half buried in the base member 23.

From FIGS. 2 and 3, it is readily understood that the first and the second permanent magnets 46 and 47 are extended from the first and the second end areas transversely of the space axis and in contact with the back surfaces of the first and the second lead members 26 and 27, respectively. More particularly, each similarly named pole, such as the north pole, of the first and the second permanent magnets 46 and 47 is brought nearer to each back surface of the first and the second lead members 26 and 27. As a result, the first and the second permanent magnets 46 and 47 substantially underlie (in the figure) the first and the second fixed contact studs 31 and 32, respectively, and are in the proximity of the first and the second fixed contact studs 31 and 32, respectively. In this structure, the first and the second lead members 26 and 27 can be shortened as compared with those illustrated in FIG. 1 because they need not support the first and the second permanent magnets 46 and 47 on the first and the second support portions axially outwardly of the first and the second contacts, respectively. In addition, a leakage magnetic flux can be reduced due to the proximity of each permanent magnet to each lead member. Therefore, each of the first and the second permanent magnets 46 and 47 may be weak and/or small in comparison with those illustrated in FIG. 1. At any rate, the illustrated relay becomes compact in size.

The armature member 35' comprises the armature 36 held on the third support portion of the third lead member 28 and a flat leaf spring 37' of a non-magnetic and electroconductive material having a central portion attached to the armature 36 and first and second extensions extended from the central portion along the space axis 25. As shown in FIGS. 2 and 3, the flat leaf spring 37' is not bent anywhere. The first and the second movable contacts 41 and 42 are attached to both ends of the first and the second extensions, respectively.

As shown in FIG. 3, the flat leaf spring 37' is bifurcated at both ends of the first and the second extensions to provide the H-shaped configuration and is supported by first and second arm members **43*a* and 43*b* connected to the central portion of the flat leaf spring 37' on both sides thereof. The first arm member 43*a* comprises a first transverse arm transverse to the space axis and a first longitudinal arm contiguous to the first transverse arm and extended along the space axis. Likewise, the second arm member 43*b* comprises a second transverse arm and a second longitudinal arm. It should be noted here that the first and the second longitudinal arms are directed away from each other along the space axis 25. More specifically, the first longitudinal arm is extended towards the second lead member 27 while the second longitudinal arm, towards the first lead member 26**. The first and the second longitudinal arms may be called a first and a second elongate portion of the first and the second arm members, respectively.

As pointed out heretobefore, it is preferable that the stiffness is invariable on both of the clockwise and counterclockwise swing movements. This keeps the sensitivity constant. For this purpose, the armature member 35' is preferably kept substantially parallel to the inner surface, as shown in FIG. 2, in an equilibrium state in which none of the first and the second permanent magnets 46 and 47 are placed adjacent to the first and the second lead members 26 and 27, respectively, and the armature member 35' is deenergized. Both ends of the first and the second longitudinal arms are attached to first and second projections 51 and 52 fixed to the third support portion of the third lead member 28 on both sides of the armature member 35'. The first and the second projections 51 and 52 are welded or otherwise fixed onto the third support portion. The first and the second longitudinal arms are also welded or likewise attached onto the first and the second projections 51 and 52, respectively. The longitudinal arms may be punched from a non-magnetic and electroconductive sheet together with the transverse arms and the flat leaf spring 37'.

The armature member 35' has a predetermined height or distance between the front surface of the third lead member 28 and an upper surface of the armature 36 in the equilibrium state illustrated in FIG. 2. Such a predetermined height may be measured from the back surface of the third lead member 28 because it is usual that the third lead member 28 has a uniform thickness.

Each of the first and the second projections 51 and 52 has a height substantially equal to the predetermined height. As a result, the flat leaf spring 37' is kept substantially parallel to the inner surface in the equilibrium state. In addition, the leaf spring 37' has no deformed portion. Therefore, it is possible to accomplish a uniform sensitivity on both clockwise and counterclockwise swing movements when the armature member 35' is swung with the first and the second permanent magnets 46 and 47 arranged as shown in FIGS. 2 and 3. It is assumed that the armature member 35' is brought into contact with the first fixed contact stud 31 when the first and the second permanent magnets 46 and 47 are used. Thus, the first and the second permanent magnets 46 and 47 serve as latching devices for keeping a predetermined one of the first and the second contacts.

In FIG. 3, the cap member 24 is attached to the base member 23 to define the afore-mentioned space therein. Each of the base member 23 and the cap member 24 may be made of a synthetic resin. The base member 23 serves to keep the first and the second permanent magnets 46 and 47 along the first and the second end areas extended transversely of the space axis 25. The coil 48 is laid between the first and the second permanent magnets 46 and 47 on the side of the base member 23 with the coil 48 electrically isolated from the first and the second permanent magnets 46 and 47. The coil 48 is extended on the cap member 24 and covered with a first yoke 56 on the cap member 24 to provide a magnetic path. A second yoke 57 is placed on the rear side of the first and the second permanent magnets 46 and 47 and the coil 48 laid on the base member 23 and is flat in shape.

The contact assemblies 22' and the base and the cap members 23 and 24 are surrounded by a pair of protection covers 59 of an insulator together with the coil 48 and the first and the second yokes 56 and 57. A pair of coil leads 61 are derived from the coil 48 through the housing 21 and a pair of the protection covers 59, although a single coil lead alone is illustrated in FIG. 3. A combination of the base member 23 and the first through the third lead members 26 to 28 will be named a relay support.

As shown in FIGS. 2 and 3, two magnets 46 and 47 which are same in magnetic characteristics, such as remanent magnetic flux density, are used to make the relay self hold magnetically. When a current-holding relay is desired, the relay may comprise only one of the magnets 46 and 47.

Figure 4A:
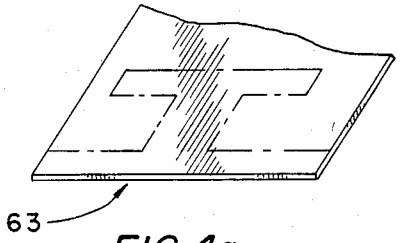
FIG. 4 shows a schematic perspective view for describing a modified method of manufacturing a lead member and a pair of projections which are equivalent to those illustrated in FIGS. 2 and 3.
Figure 4B:
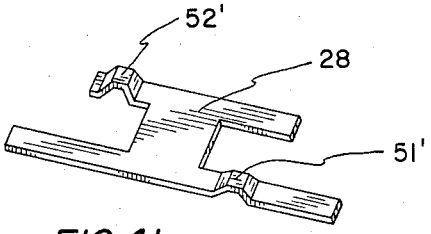

Referring to FIGS. 4(*a*) and (*b*), an example of the third lead member 28 is manufactured along with first and second projections depicted at 51' and 52' in FIG. 4(*b*). For this purpose, provision is made of a non-magnetic and electroconductive sheet 63 as shown in FIG. 4(*a*). The sheet 63 is cut off into the generally H-shaped configuration, as shown by a dot-and-dash line in FIG. 4(*a*), and is thereafter pressed to form the first and the second projections 51' and 52', as shown in FIG. 4(*b*). The first and the second projections 51' and 52' are placed to be in register with the first and the second projections 51 and 52 illustrated in FIGS. 2 and 3 and are as high as the latters. Thus, the third lead member 28 is made integral with the first and the second projections 51' and 52'.

Figure 5A:
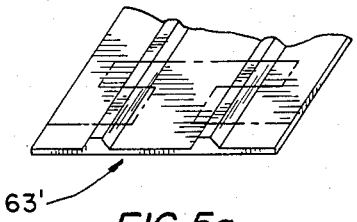
FIG. 5 shows a schematic perspective view for describing another modified method of manufacturing the lead member and the projections pair.
Figure 5B:
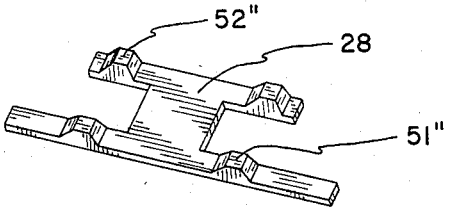

Referring to FIGS. 5(*a*) and (*b*), another form of the third lead member 28 is manufactured together with first and second projections depicted at 51'' and 52'', by the use of another method, as shown in FIG. 5(*b*). Provision is at first made of a partially deformed sheet 63' of a non-magnetic and electroconductive material as shown in FIG. 5(*a*). The illustrated sheet 63' has a pair of ridges running parallel to each other and protruding upwardly of an upper surface of the sheet 63'. Each ridge is as high as the first and the second projections 51 and 52 illustrated in FIG. 2. The distance between both ridges is equal to that of the first and the second projections 51 and 52. Like in FIG. 4, the sheet 63' is cut off into the generally H-shaped configuration along a dot-and-dash line shown in FIG. 5(*a*). The third lead member 28 is made integral with the first and the second projections 51'' and 52'' together with extra projections, as shown in FIG. 5(*b*).

Figure 6A:
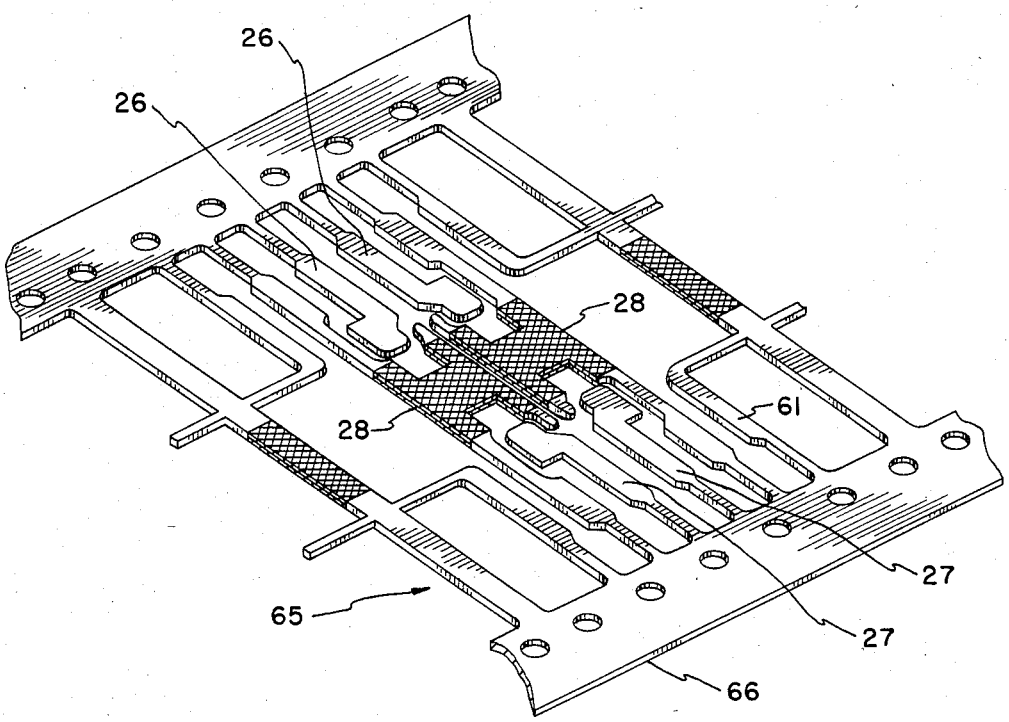
FIG. 6 shows a schematic perspective view for describing a method of manufacturing a relay support illustrated in FIGS. 2 and 3.
Figure 6B:
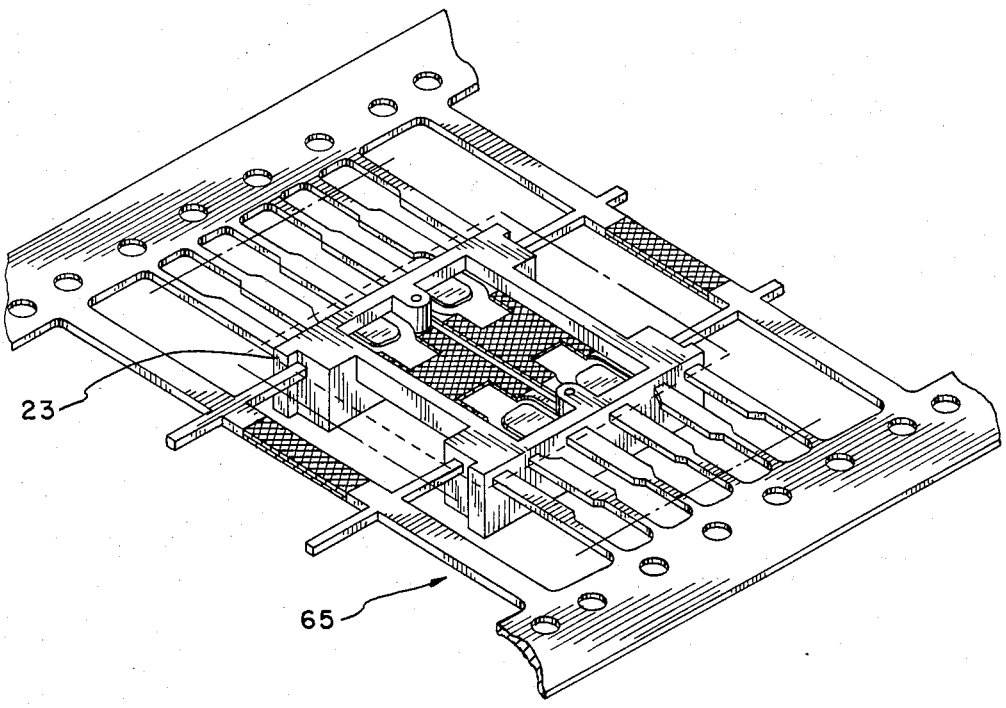

Referring to FIGS. 6(*a*) and (*b*), description will be made of a method of preparing the relay support for use in the transfer-type electromagnetic relay illustrated with reference to FIGS. 2 and 3. The relay support is a combination of the base member 23 and the first through the third lead members 26 to 28, as mentioned before, and is for supporting a pair of the armature members 35' illustrated in conjunction with FIGS. 2 and 3. The third lead member 28 has the third support portion of a non-magnetic material and the third lead portion of a magnetic material while each of the first and the second lead members 26 and 27 is wholly made of a magnetic material. The non-magnetic material may be, for example, phosphor bronze, copper alloy, or non-magnetic stainless steel. The magnetic material may be, for example, iron or iron-nickel alloy.

In order to manufacture the relay support as mentioned above, provision is made of a composite metal sheet having a central (cross-hatched) sheet area of the non-magnetic material and a first and a second sheet (non-hatched) area of the magnetic material. The first and the second sheet areas are contiguous to the central area on both sides thereof and extended in parallel to each other. Such a composite metal sheet can readily be prepared by the use of a well-known technique, such as either cladding or butt welding.

The composite metal sheet is pressed into a terminal frame, namely, a carrier blank 65 as shown in FIG. 6(*a*). The terminal frame 65 has a non-magnetic central portion in the central area of the composite metal sheet and a pair of magnetic portions laid on both sides of the non-magnetic portion and left in the first and the second sheet areas. The magnetic portions are connected to a pair of frame portions 66. The first and the second lead members 26 and 27 are formed in the first and the second sheet areas with the frame portions 66 connected thereto, respectively. The first lead member 26 has the first support portion adjacent to the central sheet area and a first elongated strip contiguous to the first support portion and extended away from the central sheet area towards the first sheet area. The second lead member 27 has the second support portion adjacent to the central sheet area and a second elongated strip contiguous to the second support portion and extended away from the central sheet area towards the second sheet area. The third lead member 28 has the third support portion of the non-magnetic material placed at the central sheet area and a third elongated strip of the magnetic material contiguous to the third support portion and extended away from the central sheet area. A pair of coil lead strips depicted at 61 are also formed in the terminal frame 65.

The terminal frame 65 is thereafter insert moulded to form the base member 23 in a well known manner, as shown in FIG. 6(*b*). As described before, the base member 23 may be of a synthetic resin. As a result of the insert moulding, the first through the third elongated strips and the coil lead strips pass through the base member 23 with the first through the third support portions left in the base member 23. In this event, the first through the third elongated strips and the coil lead strips are partially uncovered with the base member 23, as shown in FIG. 6(*b*).

Each of the first through the third elongated strips and the coil lead strips is cut off along a dot-and-dash line to form the first through the third lead portions illustrated in conjunction with FIG. 3 and the coil leads 61. Each of the lead portions and the coil leads are thereafter bent in a predetermined direction in a usual manner along a broken line. Thus, the relay support is completed.

Figure 7:
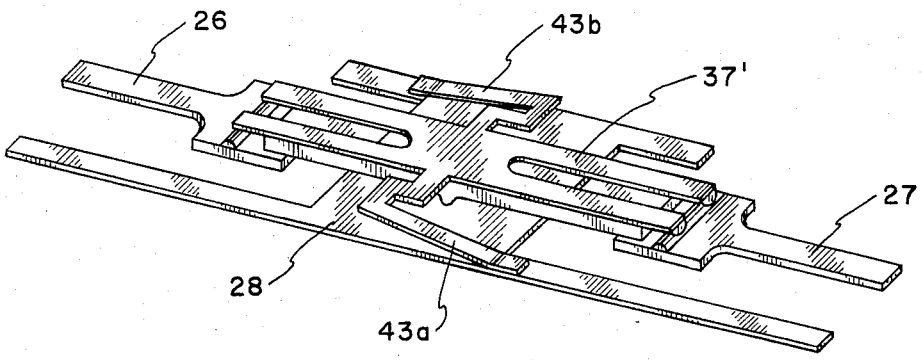
FIG. 7 shows a schematic perspective view of another contact assembly for use in the relay illustrated in FIGS. 2 and 3.

Referring to FIG. 7, a modified contact assembly is for use in the transfer-type electromagnetic relay illustrated with reference to FIGS. 2 and 3 and is similar to that illustrated in FIG. 3 except that the first and the second arm members 43*a* and 43*b* are connected direct to the third lead member 28 without the first and the second projections 51 and 52 (FIG. 3). The first and the second arm members 43*a* and 43*b* are extended from the flat leaf spring 37' on both sides thereof away from each other. In other words, the first arm member 43*a* has a first longitudinal arm directed towards the second lead member 27 while the second arm member 43*b* has a second longitudinal arm directed towards the first lead member 26, like in FIG. 3. Therefore, it is possible to keep the stiffness invariable with the modified contact assembly.

Figure 8:
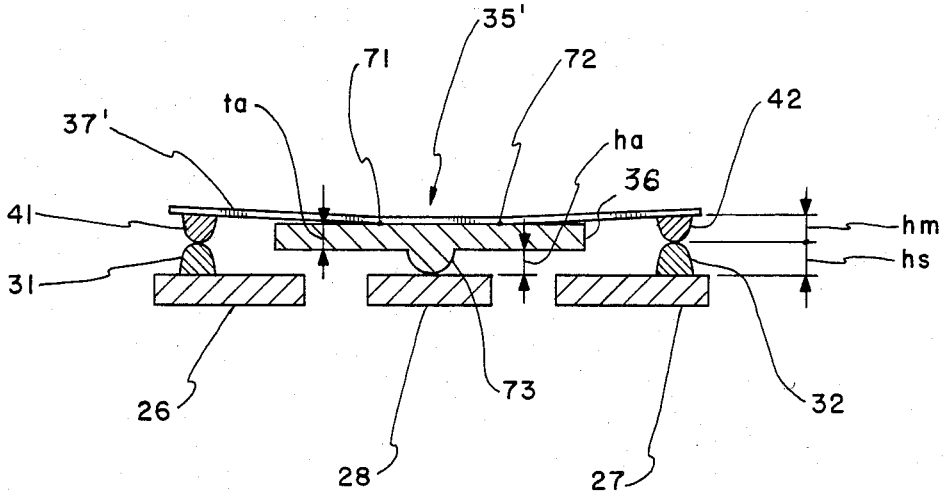
FIG. 8 schematically shows an axial sectional view of a transfer-type electromagnetic relay which has make-before-break contacts and to which this invention is applicable.

Referring to FIG. 8, attention will be directed to the case where the transfer-type electromagnetic relay illustrated with reference to FIGS. 2 and 3 is put into operation as a relay having make-before-break contacts which are concurrently and momentarily closed on transferring the contacts from one to another. The armature member 35' comprises the armature 36 and the electroconductive leaf spring 37'. The leaf spring 37' is fixed to the armature 36 by welding at first and second points 71 and 72 of the central portion of the leaf spring 37'. The first and the second movable contact studs 41 and 42 are attached to both ends of the first and the second extensions of the leaf spring 37', respectively. Let each of the first and the second movable contact studs 41 and 42 have a movable contact height represented by hm between that surface of the leaf spring 37' and that point of the movable contact stud 41 or 42 to which the stud 41 or 42 is fixed and which is farthest from the surface under consideration, respectively.

The first fixed contact stud 31 is placed on the first lead member 26 at a first predetermined position at which the first fixed contact stud 31 can be brought into contact with the first movable contact stud 41. The second fixed contact stud 32 is placed on the second lead member 27 at a second predetermined position at which the second fixed contact stud 32 can be brought into contact with the second movable contact stud 42. Let each of the first and the second fixed contact studs 31 and 32 have a fixed contact height represented by hs between the front surface of the lead member 26 or 27 and that point of the fixed contact stud 31 or 32 which is farthest from the front surface.

The armature 36 comprises an armature plate and a protrusion 73 directed from the armature plate downwards of this figure. The protrusion 73 is for swingably supporting the armature 36 on the third lead portion of the third lead member 28. Let the protrusion 73 have a height represented by ha and a thickness of the armature plate be denoted by ta. The sum of the height ha and the thickness ta may be called an armature height and is equal to that distance between the front surface of the third lead member 28 and an upper surface of the armature plate which appears when the armature 36 is kept on the third lead member 28, substantially parallel to the inner surface.

In order to design the relay having the make-before-break contacts, the armature height must be determined in consideration of the fixed contact height hs and the movable contact height hm. In the illustrated contact assembly, the armature height is rendered lower than the sum of the fixed contact height hs and the movable contact height hm. Namely;

$$ha + ta < hs + hm. \quad (1)$$

With this structure, both of the first and the second movable contact studs 41 and 42 are left in contact with the first and the second fixed contact studs 31 and 32, respectively, unless the armature member 35' carried out seesaw movement.

Figure 9A:
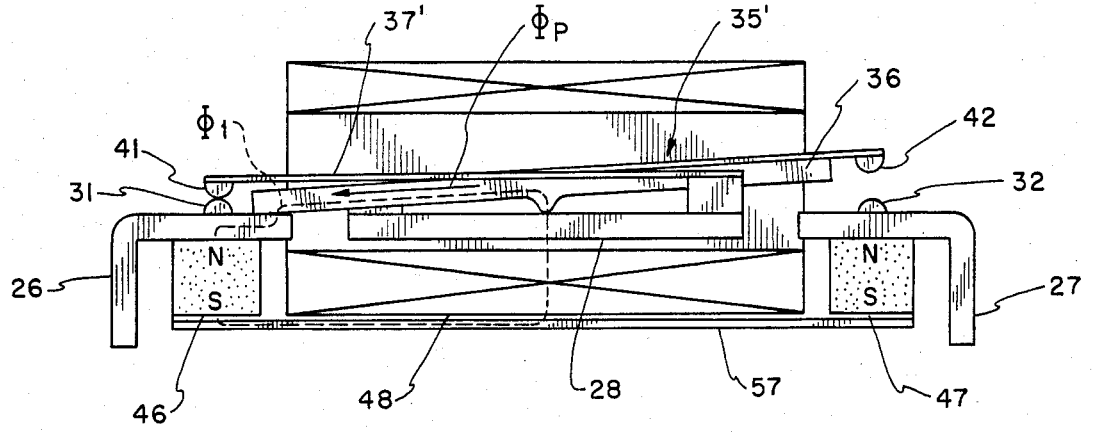
FIG. 9 schematically shows an axial sectional view for use in describing operation of the transfer-type electromagnetic relay illustrated in FIG. 8.
Figure 9B:
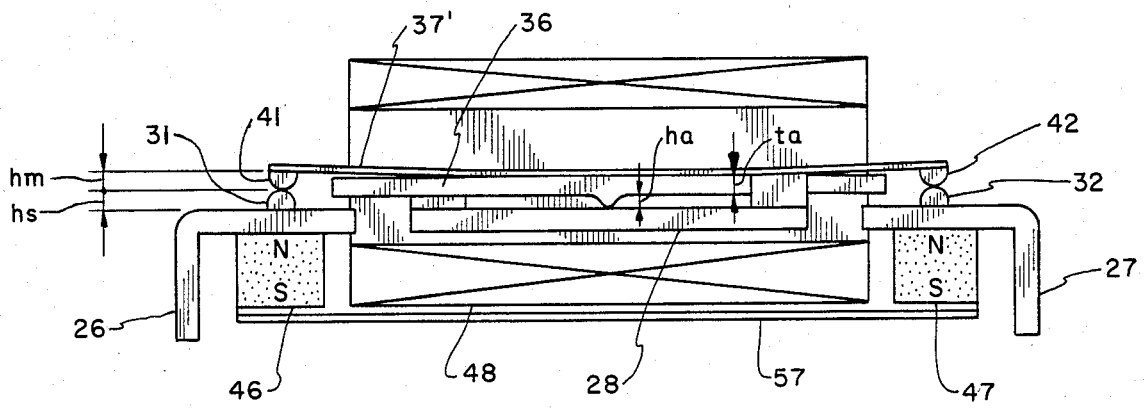
Figure 9C:
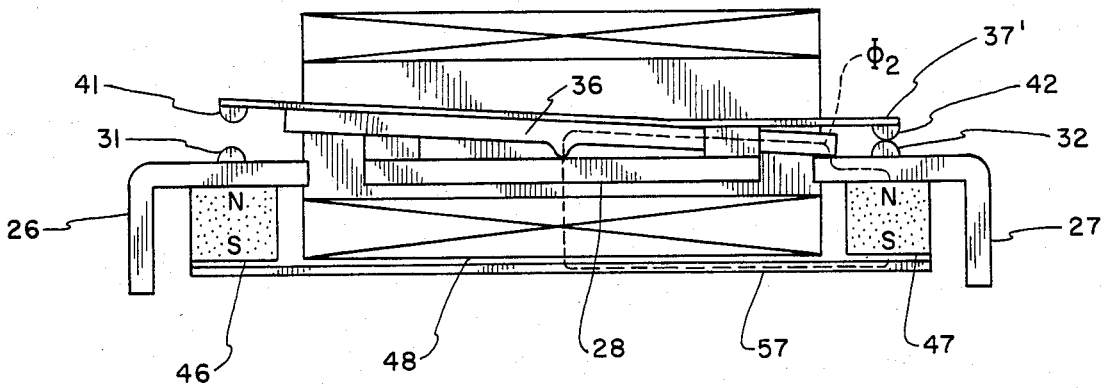

Referring to FIGS. 9(*a*), (*b*), and (*c*) and FIG. 10, description will be made about operation of the relay of the above-mentioned type. In FIGS. 9(*a*), (*b*), and (*c*), the coil 48 is controllably supplied with an electric current. Electrically selectively energized, the coil 48 produces a principal magnetic field primarily in the direction of the space axis with a predetermined one of a first and a second sense. The principal magnetic field is indicated by the principal magnetic flux $\phi_P$. In the first sense, the armature 36 is energized with a north pole produced adjacent to the lefthand side end of the armature 36. In the second sense, a south pole is produced near the lefthand end. It is surmised without loss of generality that the north poles N's of the first and the second permanent magnets 46 and 47 are brought nearer to the first and the second lead members 26 and 27.

When the coil 48 is electrically deenergized, it is assumed that the first local magnetic flux $\phi_1$ produced by the first permanent magnet 46 insures closure of the first contact between the first fixed contact stud 31 and the first movable contact stud 41, as shown in FIG. 9(*a*). Under the circumstances, the electric current is caused to flow through the coil 48 to direct the principal magnetic flux $\phi_P$ through the armature 36 as indicated by a line with an arrowhead. During the current flow, the armature 36 is magnetized so that a north and a south pole may appear adjacent to the first and the second permanent magnets 46 and 47. A repulsive force is applied to the lefthand side end of the armature 36 by cooperation of the magnetized armature 36 with the first permanent magnet 46. Attraction is applied to the righthand side end of the armature 36 by the magnetized armature 36 and the second permanent magnet 47.

As a result, the armature member 35' begins to carry out clockwise swing so as to bring the second movable contact stud 42 into contact with the second fixed contact stud 32. Inasmuch as the armature height is selected as indicated by Formula (1), the first contact is left closed even when the second movable contact stud 42 is brought into contact with the second fixed contact stud 32 to close the second contact between the second movable contact stud 42 and the second fixed contact stud 32, as illustrated in FIG. 9(*b*).

The clockwise swing is continued until the first contact is opened and the righthand side end of the armature 36 is finally attached to the second lead member 27. The second contact is kept closed by cooperation of the second local magnetic flux $\phi_2$ and the leaf spring 37' even after the coil 48 is deenergized, as shown in FIG. 9(*c*). Thus, contact transfer operation is carried out after concurrent and momentary closure of the first and the second contacts. In order to make the first contact close again, it is necessary to supply the coil 48 with an electric current in the reversed sense.

It is possible to control a duration of the concurrent and momentary closure of the first and the second contacts. For this purpose, a difference may be selected between the sum of the fixed and the movable contact heights and the armature height. This is because the duration becomes long and short with an increase and a reduction of the difference, respectively.

The above-mentioned relay does not comprise a card for use in a conventional relay of a make-before-break contact type to drive an armature member and is therefore simple in structure as compared with the conventional relay.

With the illustrated relay, a gap between each fixed contact stud and each movable contact stud becomes narrower than that of the conventional relay because the armature height is lower than the sum of the fixed contact height and the movable contact height. In order to widen the gap between both contact studs, the height of the protrusion may be rendered high. As a result, the armature 36 is swung over a long armature traveling distance from an opened position of each of the first and the second contacts to a closed position thereof.

Figure 10:
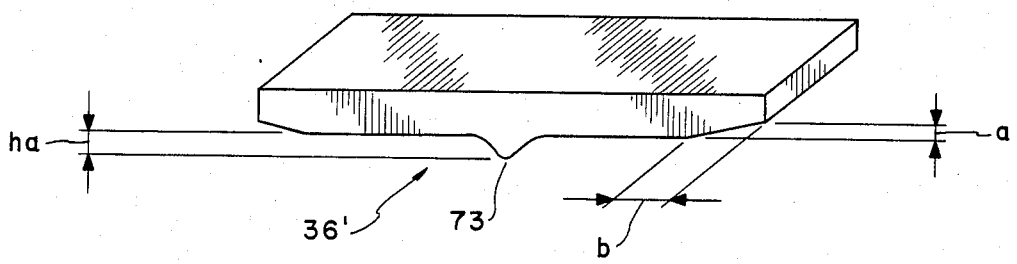
FIG. 10 shows a schematic perspective view of an armature for use in the transfer-type electromagnetic relay illustrated in FIGS. 8 and 9.

Referring to FIG. 10, another armature 36' has a pair of tapered axial end portions so as to lengthen an armature traveling distance. Each of the tapered portions gradually becomes thin as it goes away from the protrusion 73 having the height ha and has an inclination determined by a/b, as illustrated in FIG. 10. In this event, the armature traveling distance is given by (2ha+a).

Figure 11:
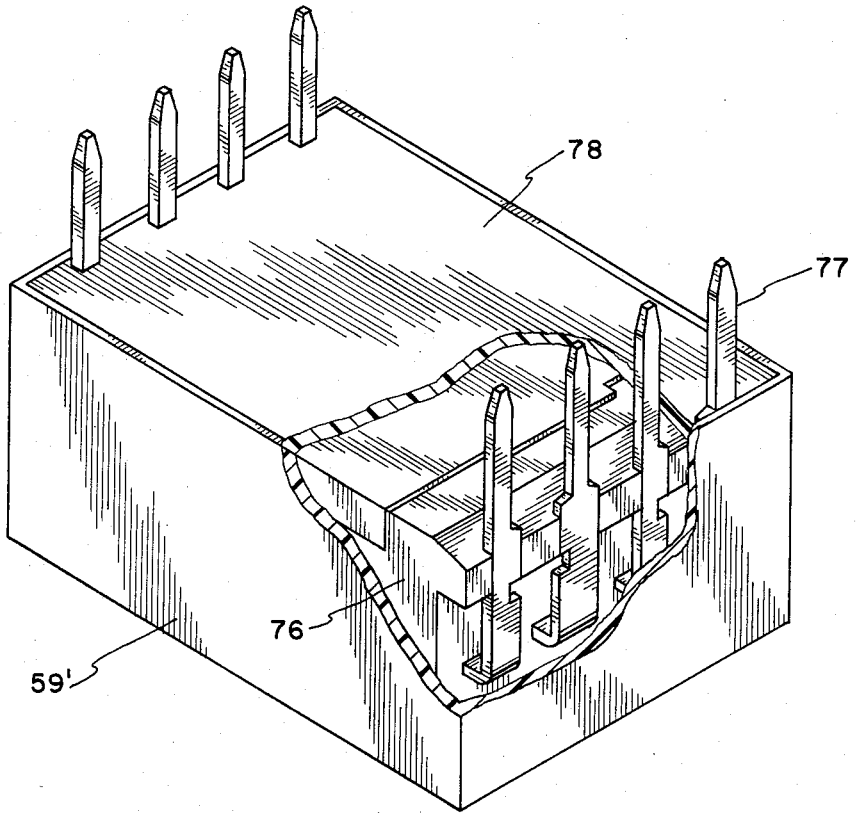
FIG. 11 shows a schematic perspective view of a relay unit according to an aspect of this invention.

Referring to FIG. 11, a transfer-type electromagnetic relay according to a modification of this invention comprises a protection cover 59' for covering a relay unit 76 illustrated in conjunction with FIGS. 2 and 3, with a back surface of the relay unit 76 exposed. All of the lead portions collectively indicated by 77 are directed to the back surface of the relay unit 76. A sealing member 78 which may be of a synthetic resin is attached to the back surface to encapsulate the relay unit 76.

While this invention has thus far been described in conjunction with a few embodiments thereof, it will readily be possible for those skilled in the art to put this invention into practice in various manners. For example, the first and the second arm members 43*a* and 43*b* may be extended in the same direction, as is the case with the conventional relay illustrated in FIG. 1, if at least one permanent magnet is directed towards the back surface of one of the first and the second lead members that is extended from a predetermined area preselected from the first and the second end areas. Each permanent magnet may be directly brought into contact with each lead member, as shown in FIG. 2. It is a matter of course that the armature height may be higher than the sum of the fixed contact height and the movable contact height unless the relay comprises the make-before-break contacts.

What is claimed is:

1. In a transfer-type electromagnetic relay comprising a housing and a contact assembly, said housing comprising a base member having an inner surface and a cap member defining a space in cooperation with said inner surface, said space having a space axis extended parallel to said inner surface, said inner surface being divisible into a center area extended transversely of said space axis and first and second end areas which are parallel to each other with said center area interposed therebetween, said contact assembly comprising a first, a second, and a third lead member which are extended from said first and said second end areas and said center area outwardly of said housing, respectively, and each of which has a front surface and a back surface, armature means swingably held on the front surface of said third lead member in said space, energizing means for electromagnetically energizing and deenergizing said armature means, and latching means for latching said armature means, said armature means being for carrying out seesaw movement in cooperation with said energizing and said latching means about an axis transverse to said space axis to electrically connect said first and said second lead members to said third lead member and to provide a first and a second contact on the front surfaces of said first and said second lead members, respectively, said energizing means being thereby for making said armature means carry out transfer of contact between said first and said second contacts, said latching means keeping at least a prede ermined one of said first and said second contacts while said armature means is left deenergized, the improvement wherein said latching means comprises:

at least one permanent magnet extending on at least a predetermined area preselected from said first and said second end areas transversely of said space axis, said permanent magnet having a selected one of north and south poles directed towards the back surface of one of said first and said second lead members that is extended from said predetermined area.

2. A transfer-type electromagnetic relay as claimed in claim 1, wherein said latching means comprises, as said at least one permanent magnet, a first permanent magnet on said first end area with the selected pole thereof directed towards the back surface of said first lead member.

3. A transfer-type electromagnetic relay as claimed in claim 2, wherein said latching means further comprises a second permanent magnet on said second end area with the selected pole of said second permanent magnet, the selected pole of said second permanent magnet being directed towards the back surface of said second lead member and named similarly as that of said first permanent magnet.

4. A transfer-type electromagnetic relay as claimed in claim 1, said armature means comprising an armature extended along said space axis, an electroconductive leaf spring comprising a central portion fixed onto said armature and a first and a second extension extended from said central portion along space axis towards said first and said second end areas, respectively, said armature means further comprising a first and a second movable contact stud directed towards said first and said second lead members on said first and said second extensions, respectively, each of said first and said second movable contact studs having a movable contact height, said first lead member comprising a first fixed contact stud at a first preselected position at which said first fixed contact stud is to be brought into contact with said first movable contact stud to form said first contact, said second lead member comprising a second fixed contact stud at a second preselected position at which said second fixed contact stud is to be brought into contact with said second movable contact stud to form said second contact, each of said first and said second fixed contact studs having a fixed contact height, wherein said armature has a predetermined height determined in consideration of both of said movable and said fixed contact heights when kept on said third lead member substantially parallel to said inner surface.

5. A transfer-type electromagnetic relay as claimed in claim 4, wherein said predetermined height is lower than a sum of said movable and said fixed contact heights.

6. A transfer-type electromagnetic relay as claimed in claim 4, wherein said predetermined height is higher than a sum of said movable and said fixed contact heights.

7. A transfer-type electromagnetic relay as claimed in claim 1, said armature means comprising an armature extended along said space axis, an electroconductive leaf spring comprising a central portion fixed onto said armature and a first and a second extension extended from said central portion along said space axis towards said first and said second end areas, respectively, and a first and a second arm member connected to said central portion on both sides thereof and to said third lead member, wherein said first and said second arm members comprise first and second elongate portions directed away from each other along said space axis and electrically connected to said third lead member, respectively.

8. A transfer-type electromagnetic relay as claimed in claim 7, wherein said first and said second arm members comprise first and second electroconductive projections attached to a first and a second predetermined point of said third lead member for supporting said first and said second elongate portions to electrically connect said first and said second elongate portions to said third lead member, respectively.

9. A transfer-type electromagnetic relay as claimed in claim 8, said armature having a predetermined height from a predetermined one of the front and the back surfaces of said third lead member when kept on said third lead member substantially parallel to said inner surface, wherein each of said first and said second projections has a height substantially equal to said predetermined height when said armature member is kept substantially parallel to said inner surface.

10. A transfer-type electromagnetic relay as claimed in claim 1, wherein said third lead member comprises a central lead portion of a non-magnetic material on said center area and an extended lead portion of a magnetic material contiguous to said central lead portion and extended outwards said housing.

11. A transfer-type electromagnetic relay as claimed in claim 10, wherein the extended lead portions of said first and said second lead members are of a common magnetic material.

12. A method of manufacturing a relay support for use in supporting a transfer-type electromagnetic relay, comprising the steps of:

preparing a composite metal sheet having a central sheet area of a non-magnetic material and a first and a second sheet area of a magnetic material contiguous to said central sheet area on both sides thereof and extended in parallel to each other;

punching said composite metal sheet into a terminal frame which has a first and a second lead member in said first and said second sheet areas, respectively, and a third lead member between said central sheet area and at least one of said first and said second sheet areas, said first lead member having a first support portion adjacent to said central sheet area and a first extended strip contiguous to said first support portion and extended away from said central sheet area while said second lead member has a second support area extended from said central sheet area and a second extended strip contiguous to said second support portion and extended away from said central sheet area towards said second sheet area, said third lead member having a third support portion of said non-magnetic material and a third extended strip contiguous to said third support portion and extended away from said central sheet area;

forming a base member of a synthetic resin to allow said first, said second, and said third extended strips to pass through said base member with said first, said second, and said third support portions left in said base member and with said first, said second, and said third extended strips partially uncovered with said base member;

partially cutting off the first, the second, and the third uncovered extended strips to form said relay support.

* * * * *